US008391760B2

(12) United States Patent
Tominaga

(10) Patent No.: US 8,391,760 B2
(45) Date of Patent: Mar. 5, 2013

(54) BELT MEMBER AND IMAGE FORMING APPARATUS

(75) Inventor: Hiroshi Tominaga, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 12/836,175

(22) Filed: Jul. 14, 2010

(65) Prior Publication Data

US 2011/0026984 A1 Feb. 3, 2011

(30) Foreign Application Priority Data

Jul. 28, 2009 (JP) ..... 2009-175240

(51) Int. Cl.
*G03G 15/01* (2006.01)

(52) U.S. Cl. ..... 399/302; 399/303

(58) Field of Classification Search ..... 399/121, 399/302, 308, 303
See application file for complete search history.

(56) References Cited

U.S. PATENT DOCUMENTS

| | | | | |
|---|---|---|---|---|
| 6,352,750 | B1 | 3/2002 | Kanetake | |
| 2007/0201897 | A1 * | 8/2007 | Maeda et al. | 399/101 |
| 2009/0067895 | A1 * | 3/2009 | Tominaga | 399/308 |

FOREIGN PATENT DOCUMENTS

| | | | |
|---|---|---|---|
| EP | 1075925 | A1 | 2/2001 |
| EP | 1075925 | B1 | 10/2003 |
| JP | 2000-056585 | A | 2/2000 |
| JP | 2001-096551 | A | 4/2001 |
| JP | 2001-117377 | A | 4/2001 |
| JP | 2002-018971 | A | 1/2002 |
| JP | 2006-184361 | A | 7/2006 |
| JP | 3868164 | B2 | 1/2007 |
| JP | 2007-240958 | A | 9/2007 |
| JP | 4011267 | B2 | 11/2007 |
| JP | 4051160 | B2 | 2/2008 |
| JP | 2009048032 | A * | 3/2009 |

OTHER PUBLICATIONS

Machine translation of JP 2009-048032 A obtained on May 17, 2012.*

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

The endless belt member which is rotationally moved as being tensioned by a plurality of tension members and which bears a toner image includes at least a base layer, a surface layer arranged on the outer circumference of the base layer, and a rib restricting movement of the belt member in the width direction intersecting to a rotational direction of the belt member, and the surface layer is harder than that of the base layer and an edge of the surface layer in the width direction of the belt is arranged at the inner side in the width direction from the rib.

19 Claims, 4 Drawing Sheets

BELT MEMBER AND IMAGE FORMING APPARATUS

BACKGROUND OF THE INVENTION

1. Field of the Invention

The present invention relates to an endless belt member which is rotationally moved as being tensioned by a plurality of tension members and an image forming apparatus including the belt member.

2. Description of the Related Art

There has been proposed a variety of image forming apparatuses to transfer a toner image by utilizing an endless belt member which is rotationally moved as being tensioned by a plurality of tension members. For example, an image forming apparatus in which a toner image is primarily transferred from a photosensitive drum to a transfer belt and the toner image borne at the transfer belt is secondarily transferred to a recording material is known. Further, an image forming apparatus in which a toner image is transferred from a photosensitive drum to a recording material borne and conveyed by a transfer belt is known.

In the abovementioned image forming apparatuses, various electrical external force or mechanical external force such as transferring of a toner image, cleaning after transferring and neutralizing, are applied to either transfer belt. Accordingly, the abovementioned transfer belt requires a variety of characteristics such as durability against the external force, that is, mechanical strength, wearability and electrical durability.

The transfer belt is scratched by carriers contained in toner when a toner image is transferred and is slid against recording materials and abutment members such as a cleaning blade and a transfer roller. Accordingly, a surface layer of the transfer belt is required to have appropriate hardness. Meanwhile, specific endurance performance needs to be satisfied while receiving stress at the vicinities of a rib for preventing belt meandering and a tension roller edge and bending stress by the tension roller.

As a transfer belt satisfying the abovementioned wearability and durability, a transfer belt utilizing resin having excellent mechanical strength of a high Young's modulus such as polyimide has been disclosed in Japanese Patent Application Laid-Open No. 2001-047451. However, with the transfer belt disclosed in Japanese Patent Application Laid-Open No. 2001-047451, there has been a problem of cost increase since the material itself is expensive. When a transfer belt is made of an inexpensive resin material, there has been a problem in durability such as wearability. Then, in Japanese Patent Application Laid-Open No. 2000-56585 and Japanese Patent Application Laid-Open No. 2006-184361, both wearability and durability have been intended to be satisfied by the arrangement of a surface layer having a higher Young's modulus than that of a base layer at the outer circumference of the base layer which is formed of an inexpensive resin material. However, there may be a case in which stress is locally concentrated at the rib for preventing meandering to prevent the belt from meandering, and then, the belt is deformed at the vicinity of the rib where the stress is concentrated. Accordingly, when the surface layer is arranged on the entire face of the belt, peeling and lifting of the surface layer occur due to the deformation of the belt, so that a problem of functionally harmful effects arises.

To address the above issues, the present invention further suppresses peeling and lifting of a surface layer of a transfer belt caused by local stress concentration at a rib for preventing meandering arranged at the transfer belt while being less expensive and having sufficient wearability and durability against external force.

SUMMARY OF THE INVENTION

According to the present invention, there is provided an endless belt member which is rotationally moved as being tensioned by a plurality of tension members and which bears a toner image, including at least: a base layer; a surface layer which is arranged on the outer circumference of the base layer; and a rib which restricts movement of the belt member in the width direction intersecting to a rotational direction of the belt member; wherein the surface layer is harder than that of the base layer and an edge of the surface layer in the width direction of the belt is arranged at the inner side in the width direction from the rib.

According to the present invention, peeling and lifting of the belt surface layer can be further suppressed while being less expensive and having sufficient wearability and durability against external force even when stress is locally concentrated at the rib arranged at the belt.

Further features of the present invention will become apparent from the following description of exemplary embodiments with reference to the attached drawings.

DESCRIPTION OF THE EMBODIMENTS

Figure 1A:
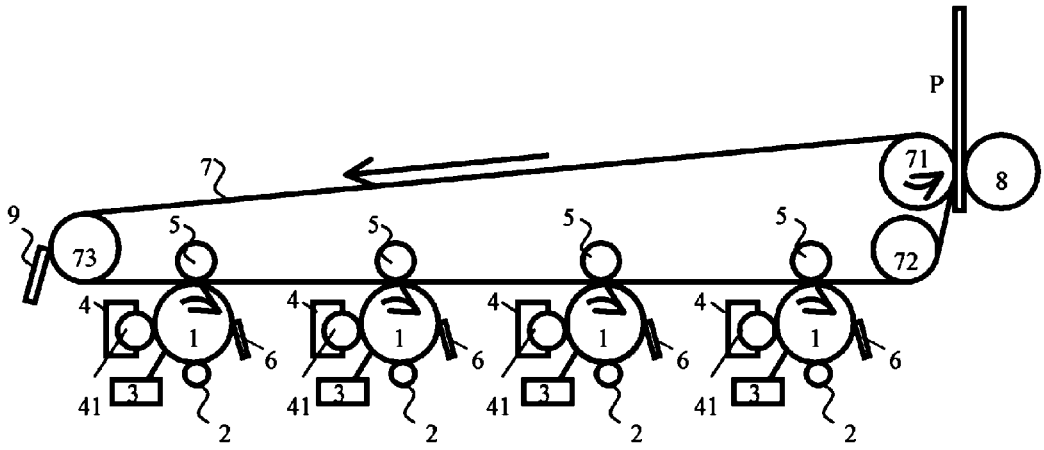
FIG. 1A is a vertical sectional view which illustrates a schematic configuration of an image forming apparatus of the first embodiment and FIG. 1B is a schematic view which illustrates a rib vicinity at an end of a transfer belt.

Exemplary embodiments of the present invention will be described in detail below in an exemplified manner with reference to the drawings. Here, dimensions, materials, shapes and relative arrangement of the structural components described in the following embodiments are to be appropriately changed in accordance with a configuration adopted by the present invention and with various conditions. The embodiments are not to be understood to limit the present invention thereto.

First, a specific example of an endless belt member which bears a toner image or a recording material is described. The belt member includes at least a base layer, a surface layer arranged at the outer circumference of the base layer, and a rib to restrict movement of the belt in the width direction intersecting to the rotational direction. The transfer belt described below is simply an example and the present invention is not limited thereto.

(1) Preparing Base Layer

The base layer is made of polyether-ether-ketone, polyvinylidene fluoride or polycarbonate resin. Here, the base layer was prepared from a cylinder-shaped film formed of polyether-ether-ketone, polyvinylidene fluoride or polycarbonate resin including an electronic conductive material of thickness 150 μm, volume resistivity $\rho v=5\times10^{9}$ (Ω·cm) and surface resistivity $\rho s=5\times10^{12}$ (Ω/□). The cylinder-shaped endless belt was prepared from the cylinder-shaped film by cylindrical extrusion molding and by cutting the film at desired length.

(2) Coating Liquid for Surface Layer Forming

Ultraviolet curable resin composition was obtained through the following processes. First, in a container where ultraviolet light is shielded, acrylic ultraviolet curable hard coating material (Desolite manufactured by JSR corporation) containing dipentaerythritol hexaacrylate of 50% in mass was mixed with isopropyl alcohol sol of zinc antimonate (Celnax manufactured by Nissan Chemical Industries, Ltd.) as conductive filler of 12% in mass. Then, methyl isobutyl ketone of 38% in mass is added. Here, the obtained composition had excellent distribution stability of the conductive filler.

(3) Preparing Belt for Electrophotograph

The surface layer is made of acrylate resin. Following methods can be mainly adopted in coating processes of the surface layer (i.e., the above-mentioned composition).

(3-1) Method by Means of Dip-Coat Method

First, masking is performed by sticking a polyimide tape (manufactured by Sumitomo 3M Corporation) on the surface of the base layer prepared in the above (1) as being non-coated area from an edge of the base layer. Then, the coating liquid for forming the surface layer prepared in the above (2) is coated on the surface of the base layer by the dip-coat method under the circumstances that temperature is 40° C. and relative humidity is 10% RH, so that a thin film of the coating liquid for forming the surface layer is formed. Thereafter, the thin film is dried for 30 seconds under the above circumstances. Subsequently, the thin film is hardened by being irradiated with ultraviolet light using a UV irradiator (UE06/81-3 manufactured by Eye Graphics Co. LTD.; integral light quantity is 1200 mJ/cm$^2$). In this manner, the surface layer according to the present invention having thickness of 5 μm can be formed on the outer circumference of the base layer.

(3-2) Method by Means of Ring-Coat Method

The inner face of the base layer prepared in above (1) is retained by a cylindrical retainer, and then, the coating liquid for forming the surface layer prepared in the above (2) is ejected only toward an area to be coated from a nozzle having a liquid ejecting port at an inner wall of a cylindrical body which is arranged to surround the circumference thereof. Accordingly, a thin film of the liquid for forming the surface layer is formed. Here, the above processes are performed under the circumstances that temperature is 40° C. and relative humidity is 10% RH. Then, the thin film is dried for 30 seconds under the above circumstances. Subsequently, the thin film is hardened by being irradiated with ultraviolet light using a UV irradiator (UE06/81-3 manufactured by Eye Graphics Co. Ltd.; integral light quantity is 1200 mJ/cm$^2$). In this manner, the surface layer according to the present invention having thickness of 5 μm can be formed on the outer circumference of the base layer.

After the above coating processes, a rib member (having width of 4 mm and height of 2 mm) made of urethane rubber having JISA hardness 70 for preventing meandering is bonded respectively to both ends in the width direction of the resin belt having the base layer and surface layer obtained as describe above. The resin belt is used for an intermediate transfer belt of the first embodiment or a transfer belt of the second embodiment as exemplified below.

First Embodiment

FIG. 1A is a schematic sectional view illustrating an example of an image forming apparatus. The entire configuration of the image forming apparatus will be described with reference to FIG. 1A. The image forming apparatus illustrated in FIG. 1A is a full-color image forming apparatus utilizing an intermediate transfer belt as the resin belt to sequentially transfer respective color toner images to the transfer belt, and then, to form an image on a recording material by batch transferring of the respective color toner images borne on the transfer belt.

The image forming apparatus illustrated in FIG. 1A includes four image forming portions which form toner images of different colors. Specifically, the image forming apparatus includes the image forming portions which respectively form a yellow toner image, a magenta toner image, a cyan toner image and a black toner image. These image forming portions are constituted with the same electrophotographic processes except for using different toner. That is, in each image forming portion, a surface of a photosensitive drum 1 as an image bearing member is evenly charged by a charger 2 and an electrostatic latent image is formed by performing light irradiation to the photosensitive drum 1 in accordance with an image signal with an exposure device 3. A development device 4 visualizes the latent image by toner development. The toner image is primarily transferred to an intermediate transfer belt 7 as an intermediate transfer member by applying bias to a primary transfer roller 5 as a primary transfer portion. The toner images of respective colors of yellow, magenta, cyan and black formed at the respective image forming portions as described above are sequentially transferred as being superposed to the intermediate transfer belt 7, so that a full-color image is formed. Then, the toner image is secondarily transferred to a conveyed recording material P by applying bias to a secondary transfer roller 8 as a secondary transfer portion. A belt cleaning device 9 eliminates transfer-remained toner on the intermediate transfer belt 7 passing through the secondary transfer portion without being transferred to the recording material P and paper dust stuck to the intermediate transfer belt 7 from the recording material P at the secondary transfer portion. Here, a cleaning blade made of polyurethane of durometer A hardness 75 having 2 mm thickness is utilized as the belt cleaning device 9. The top end of the blade abuts to the surface of the intermediate transfer belt 7 in an opposing direction, so that adherents such as the abovementioned toner and paper dust are eliminated in a frictionally sliding manner.

Here, the primary transfer roller 5 adopts a semiconductive roller material of Ascar C hardness 10° and roller resistance $1\times10^{6}\Omega$ as a semiconductive polyurethane base expanded rubber layer formed on a metal shaft. The roller resistance is calculated from current flowing through a metal plate measured at temperature 23° C. and relative humidity 50% RH in the condition that a weight of 500 g is put on each end of the metal shaft of the primary transfer roller 5 to be pressed to the metal plate which is grounded via a current meter and that voltage of 50 V is applied.

Similarly, the secondary transfer roller 8 adopts a semiconductive roller material of Ascar C hardness 30° and roller resistance $1\times10^{6}\Omega$ as a semiconductive expanded rubber layer having NBR rubber and hydrin rubber as main constituents formed on a metal shaft. The roller resistance is calculated from current flowing through a metal plate measured at temperature 23° C. and relative humidity 50% RH in the condition that a weight of 500 g is put on each end of the metal shaft of the secondary transfer roller 8 to be pressed to the metal plate which is grounded via a current meter and that voltage of 2 kV is applied.

The intermediate transfer belt 7 is rotationally moved as being tensioned by a plurality of tension members. Here, the intermediate transfer belt 7 is suspended by driven rollers 71, 72 and a drive roller 73 as the plurality of tension members. Then, the intermediate transfer belt 7 is pressed to the photosensitive drum 1 of each image forming portion by the primary transfer roller 5 and is rotationally driven in the direction of an arrow in FIG. 1 as being contacted.

Figure 1B:
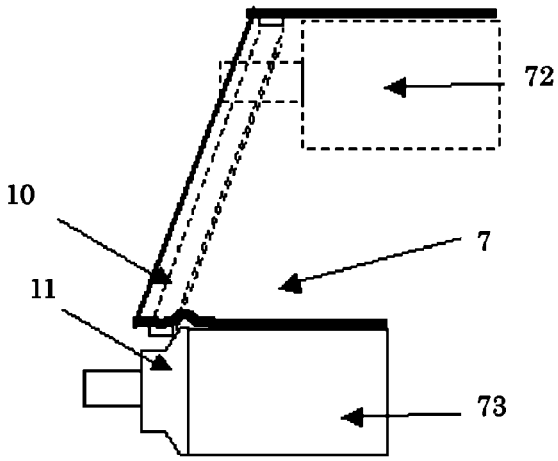

Here, the vicinity of a rib at where cracks (i.e., breakage) of the intermediate transfer belt mainly occur is described in detail with reference to FIG. 1B. The rib for usage is made of urethane rubber of JISA hardness 70 as described above and controls offset generated when the intermediate transfer belt 7 is driven by the drive roller 73. Further, a runner 11 is disposed at the end part of the drive roller 73 as a restriction member made of polyacetal to let the rib 10 and the roller slide therebetween.

Figure 2A:
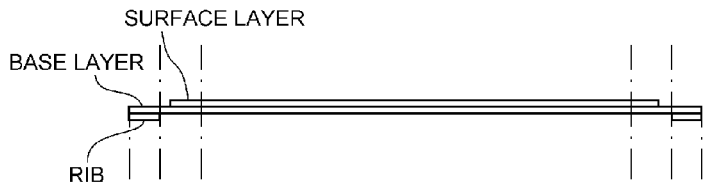
FIG. 2A is a sectional view of a main part which illustrates the rib vicinity of the end part of the transfer belt and FIG. 2B is a view which illustrates positional relation in the width direction among the transfer belt, abutment members, an image area and a sheet-passing area.
Figure 2B:
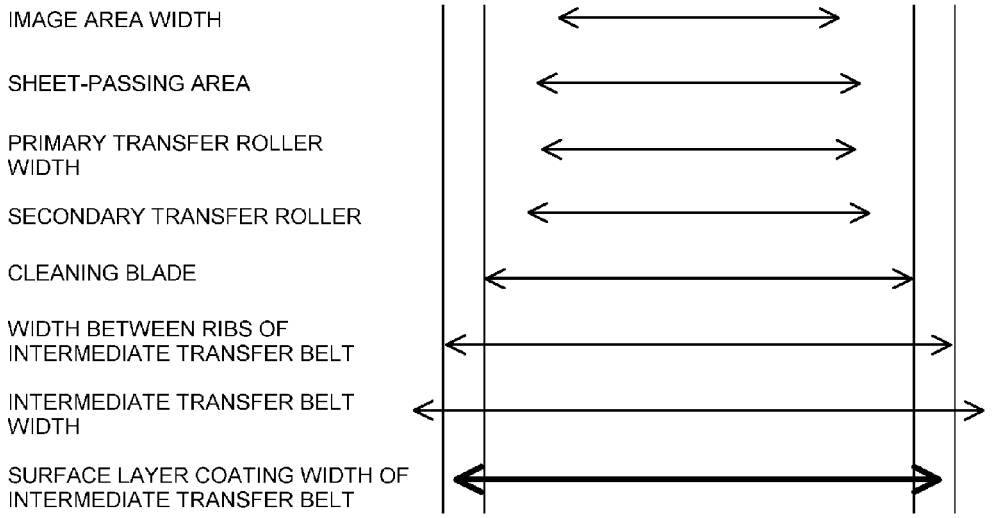

The relation among surface layer coating width of the belt, width between ribs, and length in the width direction of an image area, a sheet-passing area and various abutment members will be described with reference to FIGS. 2A and 2B. FIG. 2A is a sectional view of a main part illustrating the vicinity of the rib at the end part of the transfer belt. FIG. 2B is a view illustrating the relation of the belt position and length with the image area, the sheet-passing area and the various abutment members. Here, the width denotes the length in the direction perpendicular to (i.e., intersecting to) the rotating direction of the belt and the width direction denotes the direction intersecting to the rotating direction of the belt.

As illustrated in FIGS. 2A and 2B, the surface layer of the intermediate transfer belt having higher hardness than that of the base layer is arranged as the edge thereof in the width direction being at the inner side from the rib in the width direction. Further, the edge of the surface layer in the width direction of the belt is arranged at the outer side from the edge in the width direction of the image area where a toner image is transferred. Further, the edge of the surface layer in the width direction of the belt is arranged at the outer side from the edge in the width direction of the sheet-passing area through which a recording material passes. Furthermore, the edge of the surface layer in the width direction of the belt is arranged at the outer side from the edge in the width direction of each abutment member which abuts to the belt. Here, a primary transfer roller, a secondary transfer roller and a cleaning blade are given to illustrate the abutment members. However, the abutment members are not limited to the above.

More specifically, as illustrated in FIG. 2B, the relation of the position and length in the width direction among the image area, the sheet-passing area, the various abutment members and the belt is as follows. That is, "the image area"<"the primary transfer roller width"<"the sheet-passing area"<"the secondary transfer roller width"<"the cleaning blade width"<"the width between the ribs of the intermediate transfer belt"<"the intermediate transfer belt width".

The result by using the intermediate transfer belt 7 having the abovementioned configuration is indicated in Table 1 with variation of the coating area of the belt surface layer.

TABLE 1

| | | Non-coated width of surface layer from belt end | | | | | | | |
|---|---|---|---|---|---|---|---|---|---|
| Base layer | Surface layer | None (Coating on entire area) | To inner side by 1 mm from rib inner wall | To cleaning blade end | To secondary transfer roller end | To sheet-passing area | To primary transfer roller end | To image area | Entire surface |
| Polyether-ether-ketone | Desolite | Crack occurs after 50 thousand sheets | Excellent after 300 thousand sheets | Excellent after 300 thousand sheets | Surface roughness occurs at non-coated area below 150 thousand sheets | Surface roughness occurs at non-coated area below 150 thousand sheets | Surface roughness occurs at non-coated area below 150 thousand sheets | Surface roughness occurs at non-coated area below 150 thousand sheets | Surface roughness occurs after 50 thousand sheets |
| Polyvinylidene fluoride | Desolite | Crack occurs after 50 thousand sheets | Excellent after 300 thousand sheets | Excellent after 300 thousand sheets | Surface roughness occurs at non-coated area below 150 thousand sheets | Surface roughness occurs at non-coated area below 150 thousand sheets | Surface roughness occurs at non-coated area below 150 thousand sheets | Surface roughness occurs at non-coated area below 150 thousand sheets | Surface roughness occurs after 30 thousand sheets |
| Polycarbonate | Desolite | Crack occurs after 50 thousand sheets | Excellent after 300 thousand sheets | Excellent after 300 thousand sheets | Surface roughness occurs at non-coated area below 150 thousand sheets | Surface roughness occurs at non-coated area below 150 thousand sheets | Surface roughness occurs at non-coated area below 150 thousand sheets | Surface roughness occurs at non-coated area below 150 thousand sheets | Surface roughness occurs after 35 thousand sheets |

As can be seen from Table 1, when the non-coated width of the surface layer from the belt end is "None", that is, in the case of the belt having the surface layer arranged over the entire area of the base layer, cracks occurred on the belt surface layer after passing of 50 thousand sheets, as described above as the problem. The evaluation was continued after crack occurrence. The cracks on the surface layer developed after passing of 60 thousand sheets and cracks occurred even on the image area, so that poor imaging occurred. It is considered that the belt received stress concentration to prevent offset force at the vicinity of the rib for preventing meandering and deformation as the belt surface being pulled occurred, and then, the surface layer was cracked due to the deformation.

Meanwhile, when the edge of the surface layer exists at the inner side from the rib inner wall in the width direction by 1 mm, cracks did not occur on the belt surface layer even after passing of 300 thousand sheets and decrease in cleaning performance of toner and decrease in imaging performance did not occur. In addition, since the surface layer (i.e., a hardened layer) does not exist at the belt edge, cracks (i.e., peeling, lifting and the like of the surface layer) did not occur from the belt edge as well and excellent durability performance was obtained.

In the cases in which the edge of the surface layer exists to the secondary transfer roller end and to the sheet-passing area, cracks and poor imaging did not occur until passing of 150 thousand sheets. However, when the inside of the image forming apparatus was checked, surface roughness was observed at the non-coated area of the belt surface and slight cleaning malfunction was observed at the non-coated and cleaning area. Similarly, when the edge of the surface layer exists to the primary transfer roller end and to the image area, when checked after passing of 150 thousand sheets, cracks did not occur. However, extremely slight cleaning malfunction was observed from the surface layer edge to the sheet-passing area and surface roughness was observed at the non-coated area of the belt surface. It is considered that the above phenomenon occurred because spread toner within the image forming apparatus adhered to the non-coated area, and then, adhered to the sheet-passing end without being cleaned out. As described above, by locating the surface layer edge to the inner side in the width direction from the rib having a space from the inner wall of the rib, peeling and lifting of the belt surface layer can be suppressed while being less expensive and having sufficient wearability and durability against external force even when stress is locally concentrated at the rib arranged at the belt.

In particular, peeling and lifting of the surface layer of the transfer belt was most suppressed when the edge of the surface layer exists between the cleaning blade edge and the inner side from the inner wall of the rib by 1 mm as being the longest in the width direction among the abutment members abutting to the belt illustrated in FIG. 2B. That is, when the non-coated width of the surface layer from the belt end is to the inner side from the inner wall of the rib by 1 mm and to the blade end being inner side therefrom in the width direction, slidability and wearability of the abutment members and recording materials were improved and decrease in toner cleaning performance and decrease in imaging performance did not occur even after passing of 300 thousand sheets. In addition, since the surface layer (i.e., the hardened layer) does not exist at the belt edge, cracks (i.e., peeling, lifting and the like of the surface layer) did not occur from the belt edge as well and excellent durability performance was obtained. With the configuration as described above, peeling and lifting of the belt surface layer can be suppressed while being less expensive and having sufficient wearability and durability against external force compared to the configuration in the related art even when stress is locally concentrated at the rib arranged at the belt.

Further, as can be seen from Table 1, when the non-coated width of the surface layer from the belt end is "Entire area", that is, in the case of the belt without having the surface layer over the entire area of the base layer, slidability and wearability are inferior to the case with the surface layer due to lower surface hardness. When polyether-ether-ketone was utilized as the belt base layer, surface roughness occurred after passing of 50 thousand sheets.

In order to confirm the abovementioned result, hardness of the belt surface was measured. Specifically, measurement of two types of surface hardness was performed on a belt only of a base layer without a surface layer coated and a belt with a surface layer coated on the outer circumference of the base layer. The hardness of the belt surface was measured by utilizing ultra-micro-hardness meter nano-indenter (manufactured by MIS Systems Corporation) as the measurement instrument. More specifically, the measurement was performed with a continuous stiffness measuring method until the depth became 1.5 μm in the condition that an indenter is a diamond chip (i.e., barcobitch), vibrational frequency is 45 Hz, and a target value of displacement amplitude is 1 nm. Then, the hardness values saturated on a displacement-hardness curve were evaluated. Here, the measurement was performed ten times and the average value thereof is adopted. The result of the confirmation test is indicated in Table 2.

TABLE 2

| Evaluation sample | Anti-bent strength by MIT test | Surface hardness |
|---|---|---|
| Polyether-ether-ketone | 28 thousand times | 0.15 GPa |
| Polyvinylidene fluoride | No-breakage at 50 thousand times | 0.12 Gpa |
| Polycarbonate | 10 thousand times | 0.13 Gpa |
| Desolite | Below 200 times | 0.38 GPa |

As can be seen from Table 2, in the cases of belts respectively made of polyether-ether-ketone, polyvinylidene fluoride, and polycarbonate resin without having a surface layer, the belt surfaces respectively had hardness of 0.15 Gpa, 0.12 Gpa and 0.13 Gpa. Meanwhile, the belt having a surface layer coated on the base layer respectively made of the above resins indicated high hardness as 0.38 Gpa. With this result, it is considered that slidability and wearability were inferior due to low surface hardness and roughness was observed on the belt surface in the case of utilizing a belt without having a surface layer coated (refer to Table 1 at non-coated area being "Entire surface"). Accordingly, it is possible that the hardened layer (i.e., the surface layer) of the belt surface exists at the area used for image forming (i.e., the image area and sheet-passing area) or the area where the abutment members abut. Here, considering the influence of the hardness of the belt surface and the thickness of the surface layer to the durability of the surface layer and the abutment members, it is possible that the hardness is to be between 0.25 Gpa and 0.6 Gpa inclusive and the surface layer thickness to be between 1 μm and 10 μm inclusive. When the hardness is lower than 0.25 Gpa, the slidability and wearability is to be inferior. When the hardness is higher than 0.6 Gpa, there may be a case in which the photosensitive drum is scratched. Further, when the surface layer thickness is smaller than 1 μm, the surface layer may be worn in long-term usage. When the surface layer thickness is larger than 10 μm, the anti-bent performance may not be satisfied.

Further, regarding the crack occurrence at the vicinity of the rib for preventing meandering, evaluation was performed in order to confirm the anti-bent strength of the base layer and the surface layer of each belt in accordance with an anti-bent strength test method by the MIT type test instrument as defined in JIS-P-8115. Here, when evaluating the surface layer, the test instrument was stopped every hundred times to check presence of a crack on the surface layer. As a result, as to belts which are respectively made of polyether-ether-ketone, polyvinylidene fluoride, and polycarbonate resin without a surface layer, the anti-bent strengths are respectively in the order of 28 thousand times, more than 50 thousand times, and in the order of 10 thousand times. Meanwhile, with the belt having the surface layer coated, cracks occurred on the surface layer at one hundred times or more and less than two hundred times. From this result, when utilizing the belt having the surface layer coated over the entire belt surface, it is considered that cracks occurred on the belt surface at the rib vicinity due to insufficient anti-bent strength of the surface layer against repeated stress concentration received by the belt at the vicinity of the rib for preventing meandering. Accordingly, it is considered that satisfactory endurance performance can be obtained as exerting the anti-bent strength of the base layer when the surface layer is not coated at the vicinity of the rib.

As described above, in the belt having the surface layer arranged at the outer circumference of the base layer, the edge of the surface layer in the width direction is set to be inner side in the width direction from the rib having a space from the inner wall of the rib for preventing meandering. With this configuration, peeling and lifting of the belt surface layer caused by locally concentrated stress at the rib can be suppressed while being less expensive and having sufficient wearability and durability against external force compared to a belt in the related art.

Second Embodiment

Figure 3A:
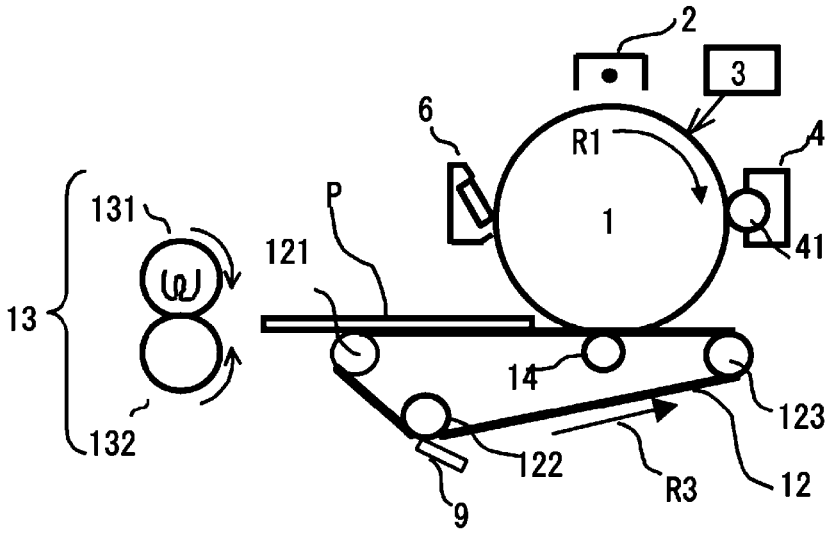
FIG. 3A is a vertical sectional view which illustrates a schematic configuration of an image forming apparatus of the second embodiment and FIG. 3B is a schematic view which illustrates a rib vicinity at an end of a transfer belt.

FIG. 3A is a schematic sectional view illustrating an example of an image forming apparatus. The entire configuration of the image forming apparatus will be described with reference to FIG. 3A. The image forming apparatus illustrated in FIG. 3A is a monocolor image forming apparatus utilizing a transfer belt as the resin belt to form an image by transferring a toner image from a photosensitive drum to a recording material which is borne and conveyed by the transfer belt.

The image forming apparatus illustrated in FIG. 3A includes one image forming portion. At the image forming portion, a toner image is formed on a photosensitive drum 1 as an image bearing member and is transferred to a recording material P at the transfer portion. The recording material P having the toner image transferred at the transfer portion is discharged to the outside of the image forming apparatus after the toner image is fixed on the surface thereof by receiving heat and pressure by a fixing device 13.

The fixing device 13 is a fixing unit constituted with a fixing roller 131 having a halogen heater arranged and a pressure roller 132 being pressed thereto. The fixing device 13 fixes the toner image electrostatically borne on the recording material P to the surface of the recording material P with heat and pressure.

The image forming portion will be described below.

As illustrated in FIG. 3A, the image forming portion includes a charger 2, an exposure device 3, a development device 4, a transfer roller 14, a cleaning device 6 and a transfer belt 12 arranged around the photosensitive drum 1.

In the photosensitive drum 1, a photoconductive layer of amorphous silicon having positive charging polarity is formed at the outer circumferential face of an aluminum-made cylinder. The photosensitive drum 1 is rotated in the direction of arrow R1 at the process speed of 500 mm/sec by a drive motor (not illustrated).

The charger 2 is a scorotron charger to charge the photosensitive drum 1 evenly at +400 V potential.

The exposure device 3 writes an electrostatic latent image at the charged surface of the photosensitive drum 1 by scanning laser beams obtained by ON-OFF modulating scan line image data having the image expanded with a rotational mirror.

The development device 4 adopts a jumping development method utilizing positive magnetic polarity charged toner of single constituent as developer. The positive magnetic polarity charged toner of single constituent having average grain diameter of about 6 μm is maintained as a thin film on a development sleeve 41 as a rotating developer bearing member having a magnetic field generating unit within the development device 4. At a position where the toner is faced to the photosensitive drum 1 in a non-contact state, development bias having rectangular AC bias of frequency 2 kHz and peak-to-peak voltage 1 kVpp superposed to DC bias of +250 V is applied to the development sleeve 41. Accordingly, the toner flies onto the photosensitive drum 1 facing to the development sleeve 41 having a space of 200 μm, so that the electrostatic latent image is developed.

The transfer belt 12 as a transfer conveying member is supported as hanging around a separating roller 121 (also serves as a drive roller), a cleaning counter roller 122 and a tension roller 123 while a transfer roller 14 is arranged therein.

Further, the transfer belt 12 forms a transfer portion by being pressed toward the photosensitive drum 1 with the total load of 10 N (i.e., 1000 gf). The tone image on the photosensitive drum 1 is transferred to the recording material P due to transfer bias applied to the transfer roller 14 at the transfer portion, and then, the recording material P is conveyed to a fixing portion as being sucked and maintained by the transfer belt 12 which is rotated in the direction of arrow R3 by a drive motor (not illustrated).

The transfer roller 14 arranged at the inside of the transfer belt 12 is arranged at a position to the downstream side by 2 mm in the recording material conveying direction from the opposing position to the photosensitive drum 1 as nipping the transfer belt 12 and is driven to be rotated by being pressed with total load of 3 N (i.e., 300 gf) toward the photosensitive drum 1 via the transfer belt 12.

The transfer roller 14 transfers the toner image borne on the photosensitive drum 1 charged in positive polarity to the recording material P by having direct voltage of negative polarity (i.e., transfer bias) applied during a process that the recording material P is nipped and conveyed to the transfer portion. Simultaneously, the recording material P is sucked to the transfer belt 12 due to the transfer bias.

The transfer roller 14 adopts a semiconductive roller material of Ascar C hardness 30° and roller resistance $1\times10^6\Omega$ as a semiconductive expanded rubber layer having NBR rubber and hydrin rubber as main constituents formed on a metal shaft. The roller resistance is calculated from current flowing through a metal plate measured at temperature 23° C. and relative humidity 50% RH in the condition that a weight of 500 g is put on each end of the metal shaft of the transfer roller 14 to be pressed to the metal plate which is grounded via a current meter and that voltage of 2 kV is applied.

The belt cleaning device 9 adopts a cleaning blade made of polyurethane of durometer A hardness 75 having 2 mm thickness. Then, the top end of the blade abuts to the surface of the transfer belt 12 in an opposing direction. The belt cleaning device 9 frictionally slides and eliminates paper dust adhered to the transfer belt 12 from the recording material P and fog toner adhered to the transfer belt 12 due to direct contact between the photosensitive drum 1 and the transfer belt 12.

Figure 3B:
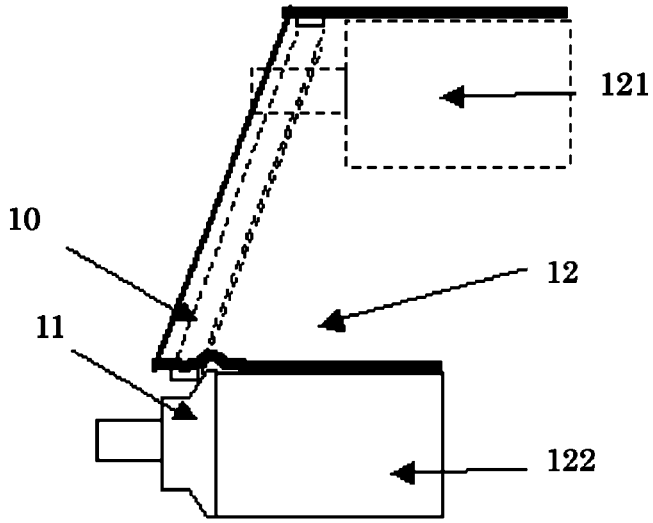

Here, FIG. 3B illustrates details at the vicinity of a rib where cracks (i.e., breakage) of the transfer belt mainly occur. The rib for usage is made of urethane rubber of JISA hardness 70 as described above and controls offset generated when the transfer belt 12 is driven by the separating roller 121. Further, a runner 11 is disposed at the end part of the cleaning counter roller 122 as a restriction member made of polyacetal to let the rib 10 and the roller slide therebetween.

Figure 4A:
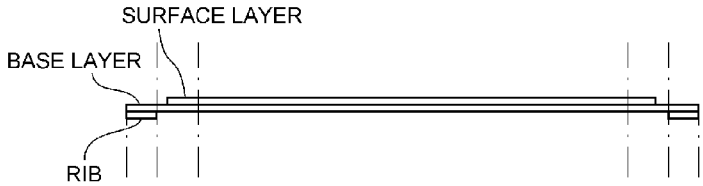
FIG. 4A is a sectional view of a main part which illustrates the rib vicinity of the end part of the transfer belt and FIG. 4B is a view which illustrates positional relation in the width direction between the transfer belt and the image forming apparatus.
Figure 4B:
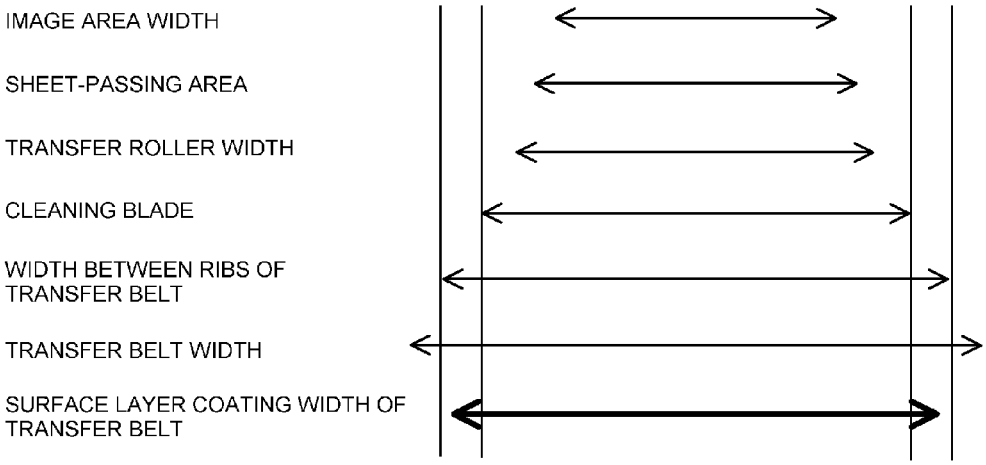

The relation among surface layer coating width of the belt, width between ribs, and length in the width direction of an image area, a sheet-passing area and various abutment members will be described with reference to FIGS. 4A and 4B. FIG. 4A is a sectional view of a main part illustrating the vicinity of the rib at the end part of the transfer belt. FIG. 4B is a view illustrating the relation of the belt position and length with the image area, the sheet-passing area and the various abutment members. Here, the width denotes the length in the direction perpendicular to (i.e., intersecting to) the rotating direction of the belt and the width direction denotes the direction intersecting to the rotating direction of the belt.

As illustrated in FIGS. 4A and 4B, the surface layer of the transfer belt having higher hardness than that of the base layer is arranged as the edge thereof in the width direction being at the inner side from the rib in the width direction. Further, the edge of the surface layer in the width direction of the belt is arranged at the outer side from the edge in the width direction of the image area where a toner image is transferred. Further, the edge of the surface layer in the width direction of the belt is arranged at the outer side from the edge in the width direction of the sheet-passing area through which a recording material passes. Furthermore, the edge of the surface layer in the width direction of the belt is arranged at the outer side from the edge in the width direction of each abutment member which abuts to the belt. Here, a transfer roller and a cleaning blade are given to illustrate the abutment members. However, the abutment members are not limited to the above.

More specifically, as illustrated in FIG. 4B, the relation of the position and length among the image area, the sheet-passing area, the various abutment members and the belt is as follows. That is, "the image area"<"the sheet-passing area"<"the transfer roller width"<"the cleaning blade width"<"the width between the ribs of the intermediate transfer belt"<"the intermediate transfer belt width".

The result by using the transfer belt 12 having the above-mentioned configuration is illustrated in Table 3 with variation of the coating area of the belt surface layer.

surface layer after passing of 100 thousand sheets, as described above as the problem. The evaluation was continued after crack occurrence. The cracks on the surface layer developed after passing of 110 thousand sheets and cracks occurred even on the image area, so that poor imaging occurred. Similar to the first embodiment, it is considered that the belt received stress concentration to prevent offset force at the vicinity of the rib for preventing meandering and deformation as the belt surface being pulled occurred, and then, the surface layer was cracked due to the deformation.

Meanwhile, when the edge of the surface layer exists at the inner side from the rib inner wall in the width direction, cracks did not occur on the belt surface layer even after passing of 100 thousand sheets, so that decrease in cleaning performance of toner and decrease in imaging performance did not occur. In addition, since the surface layer (i.e., a hardened layer) does not exist at the belt edge, cracks (i.e., peeling, lifting and the like of the surface layer) did not occur from the belt edge as well and excellent durability performance was obtained. In the cases in which the edge of the surface layer exists to the transfer roller end and to the sheet-passing area, cracks and poor imaging did not occur until passing of 200 thousand sheets. However, when the inside of the image forming apparatus was checked, surface roughness was observed at the non-coated area of the belt surface and slight cleaning malfunction was observed at the non-coated and cleaning area. Similarly, when the edge of the surface layer exists to the image area, when checked after passing of 200 thousand sheets, cracks did not occur. However, extremely slight cleaning malfunction was observed from the surface layer edge to the sheet-passing area and surface roughness was observed at the non-coated area of the belt surface. It is considered that the above phenomenon occurred because spread toner within the image forming apparatus adhered to the non-coated area, and then, adhered to the sheet-passing area without being cleaned out. As described above, by locat-

TABLE 3

| | | Non-coated width of surface layer from belt end | | | | | | |
|---|---|---|---|---|---|---|---|---|
| Base layer | Surface layer | None (Coating on entire area) | To inner side by 1 mm from rib inner wall | To cleaning blade end | To transfer roller end | To sheet-passing area | To image area | Entire surface |
| Polyether-ether-ketone | Desolite | Crack occurs after 100 thousand sheets | Excellent after 500 thousand sheets | Excellent after 500 thousand sheets | Surface roughness occurs at non-coated area below 200 thousand sheets | Surface roughness occurs at non-coated area below 200 thousand sheets | Surface roughness occurs at non-coated area below 200 thousand sheets | Surface roughness occurs after 80 thousand sheets |
| Polyvinylidene fluoride | Desolite | Crack occurs after 100 thousand sheets | Excellent after 500 thousand sheets | Excellent after 500 thousand sheets | Surface roughness occurs at non-coated area below 200 thousand sheets | Surface roughness occurs at non-coated area below 200 thousand sheets | Surface roughness occurs at non-coated area below 200 thousand sheets | Surface roughness occurs after 50 thousand sheets |
| Polycarbonate | Desolite | Crack occurs after 100 thousand sheets | Excellent after 500 thousand sheets | Excellent after 500 thousand sheets | Surface roughness occurs at non-coated area below 200 thousand sheets | Surface roughness occurs at non-coated area below 200 thousand sheets | Surface roughness occurs at non-coated area below 200 thousand sheets | Surface roughness occurs after 70 thousand sheets |

As can be seen from Table 3, when the non-coated width of the surface layer from the belt end is "None", that is, in the case of the belt having the surface layer arranged over the entire area of the base layer, cracks occurred on the belt ing the surface layer edge to the inner side in the width direction from the rib having a space from the inner wall of the rib, peeling and lifting of the belt surface layer can be suppressed while being less expensive and having sufficient wearability and durability against external force even when stress is locally concentrated at the rib arranged at the belt.

In particular, peeling and lifting of the surface layer of the transfer belt was most suppressed when the edge of the surface layer exists between the cleaning blade edge and the inner side from the inner wall of the rib as being the longest in the width direction among the abutment members abutting to the belt illustrated in FIG. 4B. That is, in the cases that the non-coated width of the surface layer from the belt end is to the inner side from the inner wall of the rib and to the blade end being inner side therefrom in the width direction, slidability and wearability of the abutment members and recording materials were improved and decrease in toner cleaning performance and decrease in imaging performance did not occur even after passing of 500 thousand sheets. In addition, since the surface layer (i.e., the hardened layer) does not exist at the belt edge, cracks (i.e., peeling, lifting and the like of the surface layer) did not occur from the belt edge as well and excellent durability performance was obtained. With the configuration as described above, peeling and lifting of the belt surface layer can be suppressed while being less expensive and having sufficient wearability and durability against external force compared to the configuration in the related art even when stress is locally concentrated at the rib arranged at the belt.

Further, as can be seen from Table 3, when the non-coated width of the surface layer from the belt end is "Entire area", that is, in the case of the belt without having the surface layer over the entire area of the base layer, slidability and wearability are inferior to the case with the surface layer due to lower surface hardness. Accordingly, surface roughness occurred after passing 100 thousand sheets or less. Specifically, in the cases of belts respectively made of polyether-ether-ketone, polyvinylidene fluoride, and polycarbonate resin without having a surface layer, surface roughness occurred respectively after 80 thousand sheets, 50 thousand sheets and 70 thousand sheets.

As described above, similarly in the present embodiment, in the belt having the surface layer arranged at the outer circumference of the base layer, the edge of the surface layer in the width direction is set to be inner side in the width direction from the rib having a space from the inner wall of the rib for preventing meandering. With this configuration, peeling and lifting of the belt surface layer caused by locally concentrated stress at the rib can be suppressed while being less expensive and having sufficient wearability and durability against external force compared to a belt in the related art.

Other Embodiment

In the above embodiments, the cases in which four image forming portions are used and in which one image forming portion is used are given as illustration. However, not limited to the above, the number of usage may be appropriately set.

Further, in the abovementioned first embodiment, the intermediate transfer belt as the intermediate transfer member in which a toner image is primarily transferred from the image bearing member and is secondarily transferred to a recording material is given as an example of the belt member. Further, in the abovementioned second embodiment, the transfer belt which bears and conveys a recording material and transfers a toner image to the conveyed recording material from the image bearing member is given as an example of the belt member. However, the endless belt member to bear a toner image or a recording sheet is not limited to the above. For example, the photosensitive drum given as an example of the image bearing member may be a photosensitive belt as being an endless belt. Instead, the belt member may be another transfer belt such that the secondary transfer roller is to be a transfer belt to transfer a toner image from the intermediate transfer belt to a recording material.

Further, the image forming apparatus utilizing the abovementioned transfer belt may be an image forming apparatus such as a printer, a copying machine and a facsimile machine or a multiple function machine having the above functions combined. Similar effects can be obtained by applying the present invention to a transfer belt used for these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-175240, filed Jul. 28, 2009, which is hereby incorporated by reference herein in its entirety.

What is claimed is:

1. An endless belt member which is rotationally moved while being tensioned by a plurality of tension members and which bears a toner image, comprising:

a rib which restricts movement of the belt member in a width direction intersecting a rotational direction of the belt member;

a base layer; and a surface layer which is arranged on the outer circumference of the base layer and which is harder than the base layer, and in the width direction of the belt member, an edge of the surface layer is arranged inside of the rib and outside of an edge of an abutment member which abuts the belt member.

2. The belt member according to claim 1, wherein the edge of the surface layer in the width direction of the belt member is arranged outside of an edge in the width direction of an image area where a toner image is borne.

3. The belt member according to claim 1, wherein the edge of the surface layer in the width direction of the belt member is arranged outside of an edge in the width direction of a sheet-passing area through which a recording material passes.

4. The belt member according to claim 1, wherein the base layer is made of polyether-ether-ketone, polyvinylidene fluoride or polycarbonate resin; and the surface layer is made of acrylate resin.

5. An endless belt member which is rotationally moved while being tensioned by a plurality of tension members and which bears a recording material having a toner image to be transferred, comprising:

a rib which restricts movement of the belt member in a width direction intersecting a rotational direction of the belt member;

a base layer; and a surface layer which is arranged on the outer circumference of the base layer and which is harder than the base layer, and in the width direction of the belt member, an edge of the surface layer is arranged inside of the rib and outside of an edge of an abutment member which abuts the belt member.

6. The belt member according to claim 5, wherein the edge of the surface layer in the width direction of the belt member is arranged outside of an edge in the width direction of an image area where the recording material is borne.

7. The belt member according to claim 5,
wherein the base layer is made of polyether-ether-ketone, polyvinylidene fluoride or polycarbonate resin; and
the surface layer is made of acrylate resin.

8. An image forming apparatus, comprising:
an endless belt member which is rotationally moved while being tensioned by a plurality of tension members and which bears a toner image, including at least a rib restricting movement of the belt member in a width direction intersecting a rotational direction of the belt member, a base layer, and a surface layer arranged on the outer circumference of the base layer;
an abutment member which abuts the belt member; and
a restriction member which abuts the rib and restricts movement in the width direction of the belt member,
wherein the surface layer is harder than the base layer, and in the width direction of the belt member, an edge of the surface layer is arranged inside of the rib and outside of an edge of the abutment member.

9. The image forming apparatus according to claim 8,
wherein the edge of the surface layer in the width direction of the belt member is arranged outside of an edge in the width direction of an image area where a toner image is borne.

10. The image forming apparatus according to claim 8,
wherein the edge of the surface layer in the width direction of the belt member is arranged outside of an edge in the width direction of a sheet-passing area through which a recording material passes.

11. The image forming apparatus according to claim 8,
wherein the base layer is made of polyether-ether-ketone, polyvinylidene fluoride or polycarbonate resin; and
the surface layer is made of acrylate resin.

12. The image forming apparatus according to claim 8,
wherein the restriction member is a runner which is arranged at an end of at least one of the tension members.

13. The image forming apparatus according to claim 8,
wherein the abutment member is a transfer roller.

14. An image forming apparatus, comprising:
an endless belt member which is rotationally moved while being tensioned by a plurality of tension members and which bears a recording material having a toner image to be transferred, including at least a rib restricting movement of the belt member in a width direction intersecting a rotational direction of the belt member, a base layer, and a surface layer arranged on the outer circumference of the base layer;
an abutment member which the belt member; and
a restriction member which abuts the rib and restricts movement in the width direction of the belt member,
wherein the surface layer is harder than the base layer, and in the width direction of the belt member, an edge of the surface layer is arranged inside of the rib and outside of an edge of the abutment member.

15. The image forming apparatus according to claim 14,
wherein the edge of the surface layer in the width direction of the belt member is arranged outside of an edge in the width direction of an image area where a toner image is borne.

16. The image forming apparatus according to claim 14,
wherein the edge of the surface layer in the width direction of the belt member is arranged outside of an edge in the width direction of a sheet-passing area through which the recording material passes.

17. The image forming apparatus according to claim 14,
wherein the base layer is made of polyether-ether-ketone, polyvinylidene fluoride or polycarbonate resin; and
the surface layer is made of acrylate resin.

18. The image forming apparatus according to claim 14,
wherein the restriction member is a runner which is arranged at an end of at least one of the tension members.

19. The image forming apparatus according to claim 14,
wherein the abutment member is a transfer roller.

* * * * *